US009230727B2

(12) United States Patent
Yoo et al.

(10) Patent No.: US 9,230,727 B2
(45) Date of Patent: Jan. 5, 2016

(54) THIN FILM TYPE COMMON MODE FILTER

(71) Applicant: SAMSUNG ELECTRO-MECHANICS CO., LTD., Suwon-si,Gyeonggi-do (KR)

(72) Inventors: Young Seuck Yoo, Suwon-si (KR); Kang Heon Hur, Suwon-si (KR); Sung Kwon Wi, Suwon-si (KR); Ho Jin Yun, Suwon-si (KR); Jong Yun Lee, Suwon-si (KR); Ju Hwan Yang, Suwon-si (KR); Jin Hyuck Yang, Suwon-si (KR); Young Do Kweon, Suwon-si (KR); Eun Ha Kim, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/830,884

(22) Filed: Mar. 14, 2013

(65) Prior Publication Data

US 2014/0062644 A1 Mar. 6, 2014

(30) Foreign Application Priority Data

Aug. 29, 2012 (KR) ..... 10-2012-0094805

(51) Int. Cl.

| | |
|---|---|
| ***H01F 5/00*** | (2006.01) |
| ***H01F 27/28*** | (2006.01) |
| ***H01F 17/00*** | (2006.01) |

(52) U.S. Cl.

CPC ..... *H01F 27/2804* (2013.01); *H01F 17/0013* (2013.01); *H01F 2017/0066* (2013.01)

(58) Field of Classification Search

CPC ..... H01F 2017/0066

See application file for complete search history.

(56) References Cited

U.S. PATENT DOCUMENTS

| | | | | |
|---|---|---|---|---|
| 5,506,551 | A * | 4/1996 | Kaneko et al. | 333/185 |
| 6,198,374 | B1 * | 3/2001 | Abel | 336/200 |
| 2010/0157565 | A1 * | 6/2010 | Yoshida et al. | 361/811 |

FOREIGN PATENT DOCUMENTS

| | | |
|---|---|---|
| KR | 10-2003-0068587 | 8/2003 |
| KR | 10-2007-0061784 | 6/2007 |

* cited by examiner

*Primary Examiner* — Elvin G Enad
*Assistant Examiner* — Ronald Hinson
(74) *Attorney, Agent, or Firm* — McDermott Will & Emery LLP

(57) ABSTRACT

Disclosed herein is a common mode filter including an internal electrode manufactured in a coil electrode form and provided with a simultaneous coil pattern in which two coil electrodes are overlapped with each other in a single layer in a direction in which a coil is wound, wherein a height of a second insulating layer formed on the internal electrode is higher than an interval between the coils. Therefore, a portion at which a parasitic capacitance is generated may be basically blocked, and a self resonant frequency (SRF) may be increased while filtering performance as the common mode filter is maintained.

3 Claims, 3 Drawing Sheets

- PRIOR ART -

- PRIOR ART -

THIN FILM TYPE COMMON MODE FILTER

CROSS REFERENCE(S) TO RELATED APPLICATIONS

This application claims the benefit under 35 U.S.C. Section 119 of Korean Patent Application Serial No. 10-2012-0094805, entitled "Thin Film Type Common Mode Filter" filed on Aug. 29, 2012, which is hereby incorporated by reference in its entirety into this application.

BACKGROUND OF THE INVENTION

1. Technical Field

The present invention relates to a thin film type common mode filter, and more particularly, to a thin film type common mode filter including an internal electrode manufactured in a coil electrode form and provided with a simultaneous coil pattern in which two coil electrodes are overlapped with each other in a single layer in a direction in which a coil is wound, wherein a height of a second insulating layer formed on the internal electrode is higher than an interval between the coils to decrease a parasitic capacitance component.

2. Description of the Related Art

Recently, electronic devices such as cellular phones, electric home appliances, personal computers (PCs), personal digital assistants (PDAs), liquid crystal displays (LCDs), navigations, or the like, have been digitized and accelerated. Since the electronic devices are susceptible to a stimulus from the outside, a circuit is damaged or a signal is distorted in the case in which a small level of abnormal voltage and a high frequency noise are introduced from the outside into an internal circuit of the electronic device.

The abnormal voltage and the noise are resulted from a switching voltage generated in the circuit, a power supply noise included in a power supply voltage, unnecessary electromagnetic signal, and an electromagnetic noise, or the like, and a common mode filter (CMF) has been used as a means for preventing the abnormal voltage and the noise from being introduced to the circuit.

In general, in a differential signal transmission system, a passive component such as a diode, a varistor, or the like, has been separately used in order to suppress an electro static discharge (ESD) generated at input and output terminals together with the CMF for removing a common mode noise.

FIGS. 1A and 1B are schematic diagrams showing a structure of a common mode filter of the related art. Referring to FIGS. 1A and 1B, the general common mode filter includes a base substrate 1, a first insulating layer 2 formed on the base substrate 1, an internal electrode 3 formed on the first insulating layer 2, a second insulating layer 4 formed on the first insulating layer 2 so as to receive the internal electrode 3, an external electrode terminal 5 formed on the second insulating layer 4 so as to ground an exposed end of the internal electrode 3, and a ferrite resin layer 6 formed on the second insulating layer 4.

However, in the above-mentioned common mode filter of the related art, a parasitic capacitance is generated due to structural properties.

A region indicated by the part "A" of FIGS. 1A and 1B is a region at which the parasitic capacitance is generated.

As shown in FIG. 1A, the parasitic capacitance is intensively generated at different electrified circuits, that is, above and below a vicinity at which the internal electrode 3 and the external electrode terminal 5 are mutually close to each other, in particular, in the vicinity of a boundary therebetween.

In addition, as shown in FIG. 1B, the parasitic capacitance is generated between a plurality of internal electrodes 3 formed in each layer.

The internal electrode 3 of the related art is manufactured in a coil form, and a structure thereof in the related art having different forms of coils formed in a single layer cannot but generate the parasitic capacitance. In addition, the parasitic capacitance is a main reason that a self resonant frequency (SRF) is damaged.

SUMMARY OF THE INVENTION

An object of the present invention is to provide a thin film type common mode filter capable of fundamentally interrupting a portion at which a parasitic capacitance is generated by including an internal electrode manufactured in a coil electrode form and provided with a simultaneous coil pattern in which two coil electrodes are overlapped with each other in a single layer in a direction in which a coil is wound, and highly forming a height of a second insulating layer formed on the internal electrode than an interval between the coils.

According to an exemplary embodiment of the present invention, there is provided a thin film type common mode filter including an internal electrode manufactured in a coil electrode form and provided with a simultaneous coil pattern in which two coil electrodes are overlapped with each other in a single layer in a direction in which a coil is wound, wherein a height of a second insulating layer formed on the internal electrode is higher than an interval between the coils to decrease a parasitic capacitance component.

According to another exemplary embodiment of the present invention, there is provided a thin film type common mode filter including: a base substrate made of an insulating material; a first insulating layer formed on the base substrate; an internal electrode manufactured in a single layer on the first insulating layer and provided with a simultaneous coil pattern in which two coil electrodes are overlapped with each other in the single layer in a direction in which a coil is wound, a second insulating layer formed on the internal electrode so as to be higher than an interval between the coils; an external electrode terminal having a vertical section connected to a side surface of the internal electrode and a horizontal section extended from an upper end of the vertical section toward a horizontal direction to thereby form a parallel surface spaced apart from the internal electrode by a predetermined distance; and a ferrite resin layer formed so as to receive portions of side walls in vertical sections of the first insulating layer, the second insulating layer, and the external electrode terminal therein.

The base substrate may be made of a ferrite.

The first insulating layer and the second insulating layer may be made of any one material selected from the group consisting of polyimide, an epoxy resin, BCB), and other polymers.

DESCRIPTION OF THE PREFERRED EMBODIMENTS

Hereinafter, exemplary embodiments of the present invention will be described in detail with reference to the accompanying drawings.

Figure 1A:
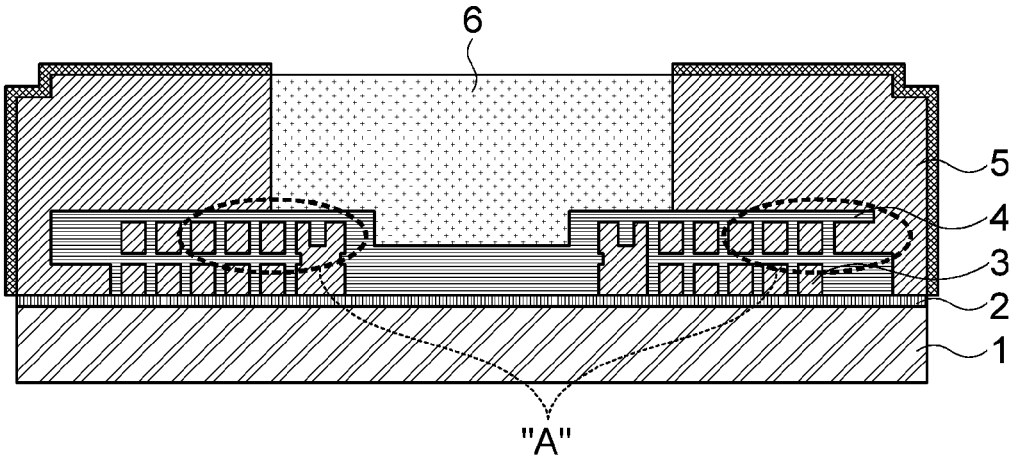
FIGS. 1A and 1B are schematic diagrams showing a common mode filter structure of the related art.
Figure 1B:
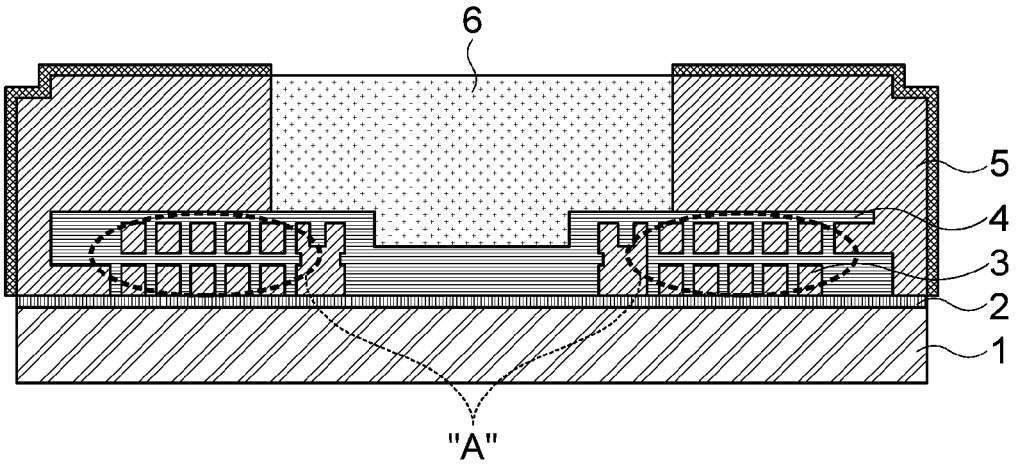
Figure 2:
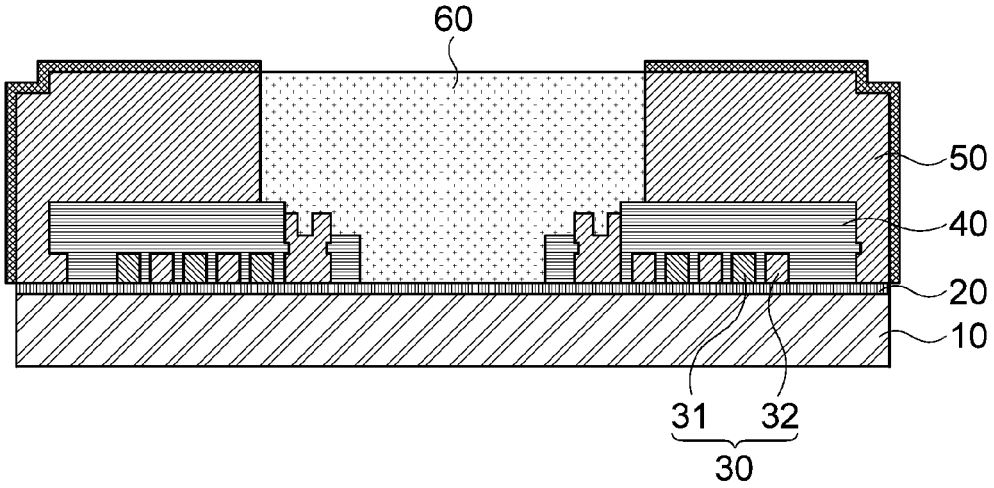
FIG. 2 is a conceptual diagram showing a cross-sectional structure of a thin film type common mode filter according to an exemplary embodiment of the present invention.

FIG. 2 is a conceptual diagram showing a cross-sectional structure of a thin film type common mode filter according to an exemplary embodiment of the present invention.

Referring to FIG. 2, the common mode filter of the present invention includes an internal electrode 30 manufactured in a coil electrode form and provided with a simultaneous coil pattern in which two coil electrodes are overlapped with each other in a single layer in a direction in which a coil is wound, and a height of a second insulating layer 40 formed on the internal electrode is higher than an interval between the coils to thereby decrease a parasitic capacitance component.

The thin film type common mode filter according to the exemplary embodiment of the present invention includes a base substrate 10 made of an insulating material; a first insulating layer 20 formed on the base substrate 10; an internal electrode 30 manufactured in a single layer on the first insulating layer 20 and provided with a simultaneous coil pattern in which two coil electrodes are overlapped with each other in the single layer in a direction in which a coil is wound, a second insulating layer 40 formed on the internal electrode 30 so as to be higher than an interval between the coils; an external electrode terminal 50 having a vertical section connected to a side surface of the internal electrode and a horizontal section extended from an upper end of the vertical section toward a horizontal direction to thereby form a parallel surface spaced apart from the internal electrode 30 by a predetermined distance; and a ferrite resin layer 60 formed so as to receive portions of side walls of vertical sections of the first insulating layer 20, the second insulating layer 40, and the external electrode terminal 50 therein.

FIGS. 3A to 3D are conceptual diagrams sequentially showing a manufacturing process of a thin film type common mode filter according to an exemplary embodiment.

Figure 3A:
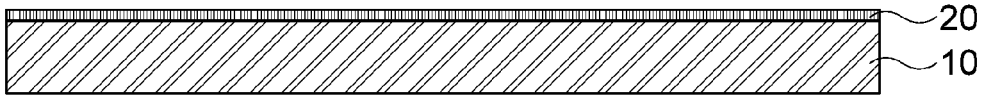
FIGS. 3A to 3D are conceptual diagrams sequentially showing a manufacturing process of a thin film type common mode filter according to an exemplary embodiment of the present invention.

As shown in FIG. 3A of the present invention, the first insulating layer 20 is formed on the base substrate 10.

Here, the base substrate 10 may be manufactured by using an insulating material, for example, a ferrite material.

In addition, the first insulating layer 20 may be manufactured by using one material selected from the group consisting of polyimide, an epoxy resin, benzocyclobutene (BCB), and other polymers, and by controlling impedance by controlling a thickness of a spin coating layer.

Figure 3B:
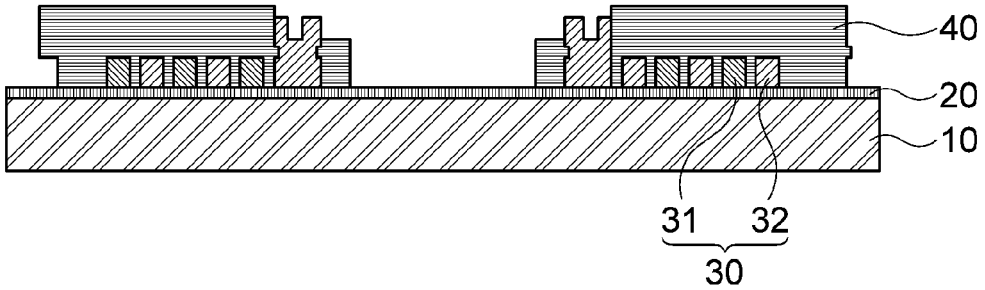

In addition, as shown in FIG. 3B, the internal electrode 30 and the second insulating layer 40 may be formed on the first insulating layer 20.

The internal electrode 30 may be manufactured in a coil form, wherein one end of the coil form is an exposed end connected to a side of the external electrode terminal, and the other end of the coil form is a connection end grounding the plurality of internal electrodes.

Figure 4:
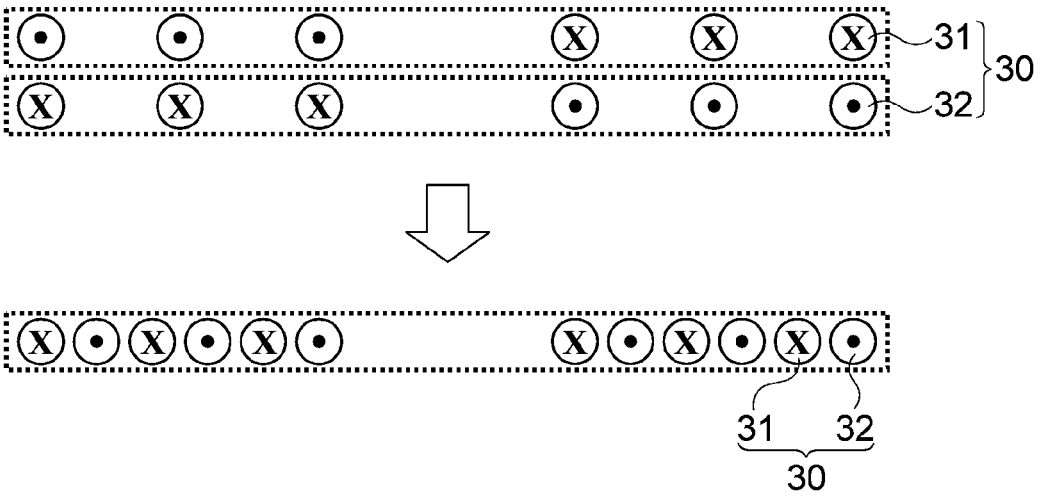
FIG. 4 is a conceptual diagram showing an arrangement structure of a cross-section of an internal electrode of a thin film type common mode filter according to the exemplary embodiment of the present invention.

FIG. 4 is a conceptual diagram showing an arrangement structure of a cross-section of the internal electrode of the thin film common mode filter according to the exemplary embodiment of the present invention.

Referring to FIG. 4, the internal electrode 30 is manufactured in a single layer on the first insulating layer 20 and provided with a simultaneous coil pattern in which two coil electrodes are overlapped with each other in the single layer in a direction in which a coil is wound.

Accordingly, at the time of applying a differential mode signal of the simultaneous coil, an operation of the above-mentioned structure is the same as the operation of the structure to be upwardly and downwardly operated of the related art, thereby securing a structure in which a filtering effect is the same as that of the related art, and a self resonant frequency (SRF) is increased.

In addition, the second insulating layer 40 is formed on the internal electrode 30, and is highly formed rather than an interval between the coils to thereby form a space at which the internal electrode 30 and the external electrode terminal 50 are spaced apart from each other.

The second insulating layer 40 may be made of any one material selected from the group consisting of polyimide, an epoxy resin, BCB, and other polymers, and formed by a photo via process.

Here, in the photo via process, a specific development ink including an insulating resin is used as an insulating layer and the insulating layers are multilayered.

Here, the second insulating layer 40 may be formed on only the internal electrode 30.

In addition, the external electrode terminal 50 has a vertical section connected to a side surface of the internal electrode 30 and a horizontal section extended from an upper end of the vertical section toward a horizontal direction to thereby form a parallel surface spaced apart from the internal electrode 30 by a predetermined distance.

Figure 3C:
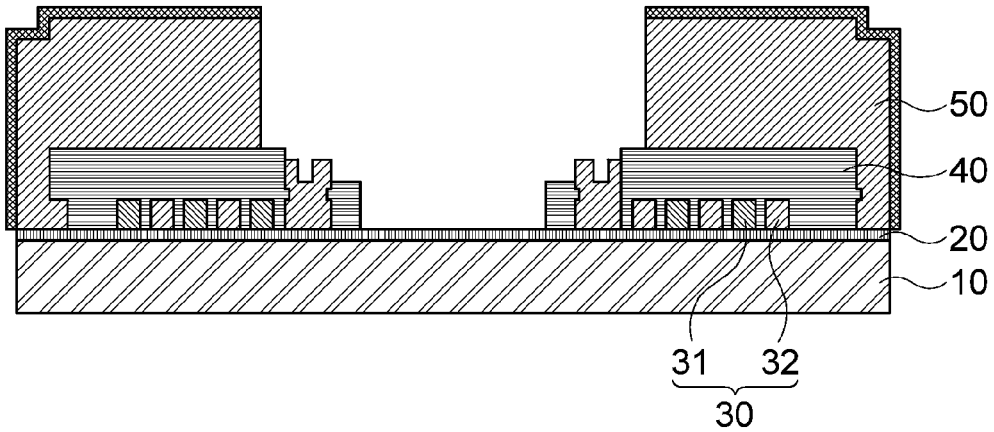

In addition, as shown in FIG. 3C, the external electrode terminal 50 is formed on the second insulating layer 40. Here, the external electrode terminal 50 has a vertical section connected to a side surface of the internal electrode 30 and a horizontal section extended from an upper end of the vertical section toward a horizontal direction to thereby form a parallel surface spaced apart from the internal electrode 30 by a predetermined distance.

Figure 3D:
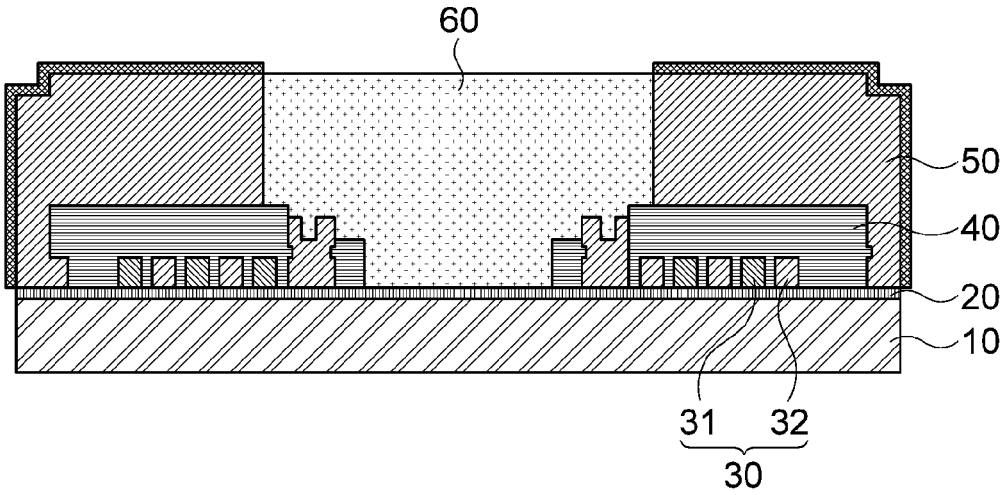

In addition, as shown in FIG. 3D, the ferrite resin layer is formed so as to receive portions of side walls in vertical sections of the first insulating layer 20, the second insulating layer 40, and the external electrode terminal 50 therein.

Here, the vertical section of the external electrode terminal 50 is protruded to have a predetermined height, and a space at which the external electrode terminal 50 and the internal electrode 30 are spaced to each other is formed by a height at which the vertical section of the external electrode terminal 50 is protruded.

As described above, the common mode filter of the present invention includes the internal electrode manufactured in a coil electrode form and provided with the simultaneous coil pattern in which two coil electrodes are overlapped with each other in the single layer in the direction in which the coil is wound, wherein a height of a second insulating layer formed on the internal electrode is higher than an interval between the coils, such that a portion at which a parasitic capacitance is generated may be fundamentally interrupted, and the self resonant frequency (SRF) may be increased while maintaining the filtering performance as the common mode filter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. A thin film type common mode filter comprising:

a base substrate made of an insulating material;

a first insulating layer formed on the base substrate;

an internal electrode manufactured in a single layer on the first insulating layer and provided with a simultaneous coil pattern in which two coil electrodes are overlapped with each other in the single layer in a direction in which a coil is wound, a second insulating layer formed on the internal electrode, a height of the second insulating layer being higher than an interval between the coils in the single layer;

an external electrode terminal having a vertical section connected to a side surface of the internal electrode and a horizontal section extended from an upper end of the vertical section toward a horizontal direction to thereby form a parallel surface spaced apart from the internal electrode by a predetermined distance, wherein the height of the second insulating layer is an interval between the internal electrode and the horizontal section of the external electrode terminal, and the horizontal section is provided in contact with a horizontal surface of the second insulating layer and overlapped with the internal electrode in a vertical direction; and a ferrite resin layer formed so as to receive portions of side walls in vertical sections of the first insulating layer, the second insulating layer, and the external electrode terminal therein, and to penetrate between the vertical sections of the second insulating layer.

2. The thin film type common mode filter according to claim 1, wherein the base substrate is made of a ferrite.

3. The thin film type common mode filter according to claim 2, wherein the first insulating layer and the second insulating layer are made of any one material selected from the group consisting of polyimide, an epoxy resin, BCD), and other polymers.

* * * * *